United States Patent [19]

West

[11] Patent Number: 4,703,228

[45] Date of Patent: Oct. 27, 1987

[54] APPARATUS AND METHOD FOR PROVIDING A MODULATED ELECTRON BEAM

[75] Inventor: William P. West, Poway, Calif.

[73] Assignee: GA Technologies Inc., San Diego, Calif.

[21] Appl. No.: 770,386

[22] Filed: Aug. 28, 1985

[51] Int. Cl.[4] ..... H05B 37/02; H05B 39/04; H05B 41/36

[52] U.S. Cl. ..... 315/149; 315/3; 315/4; 315/5.41; 372/26; 372/74

[58] Field of Search ..... 315/149, 150, 4, 5, 315/3, 5.41, 5.42; 372/74, 26

[56] References Cited

U.S. PATENT DOCUMENTS

| | | | |
|---|---|---|---|
| 3,267,383 | 8/1966 | Lohmann | 315/4 X |
| 3,403,257 | 9/1968 | Petroff | 315/5 X |
| 3,622,833 | 11/1971 | Takeda et al. | 315/4 |
| 3,730,979 | 5/1973 | Schwarz et al. | 315/4 |
| 3,912,367 | 10/1975 | Mann | 350/160 R |
| 4,313,072 | 1/1982 | Wilson | 315/5 |
| 4,346,330 | 8/1982 | Lee et al. | 315/150 |
| 4,392,080 | 7/1983 | Maschke | 315/5.41 |
| 4,401,920 | 8/1983 | Taylor et al. | 315/150 |
| 4,453,108 | 6/1984 | Freeman, Jr. | 315/5 |
| 4,570,103 | 2/1986 | Schoen | 315/4 |

OTHER PUBLICATIONS

Abrams, R. L. and Grandrud, W. B., "*Heterodyne Detection of 10.6-u Radiation By Metal-To-Metal Point Contact Diodes*", Applied Physics Letters, vol. 17, No. 1, Aug. 15, 1980.

*Primary Examiner*—Saxfield Chatmon
*Attorney, Agent, or Firm*—Fitch, Even, Tabin & Flannery

[57] ABSTRACT

An electron gun for emitting a modulated electron beam. The gun includes an evacuated envelope having an output end with a photocathode positioned in the envelope and responsive to light to emit electrons. An anode is positioned between the photocathode and the output end for accelerating the electrons emitted by the photocathode. The gun further includes a source of potential interconnecting the anode and the photocathode for maintaining the anode electrostatically positive relative to the photocathode. A first laser provides a first laser beam at a first frequency illuminating the photocathode, and a second laser provides a second laser beam at a second frequency illuminating the photocathode at the same time. The first frequency differs from the second frequency by a beat frequency, whereby the photocathode provides the electron beam with the electrons spacially bunched in accordance with the beat frequency. A method of providing a modulated electron beam is also disclosed.

10 Claims, 4 Drawing Figures

APPARATUS AND METHOD FOR PROVIDING A MODULATED ELECTRON BEAM

This invention relates generally to particle beams and, more specifically, to an electron gun and a method for providing a modulated electron beam.

BACKGROUND OF THE INVENTION

Electron beams used for radio frequency (RF) power generation are frequently bunched spatially. Examples of devices requiring a spatially bunched electron beam to provide an electomagnetic radiation output because of the relativistic effect of electrons (the negative mass instability of relativistic electrons) are the free electron laser, which provides an optical output, and the gyrotron, which has a microwave output. High frequency RF power sources are of interest to the military for communication and directed energy weapons. Additionally, such a power source is also of interest to the fusion community for electron-cyclotron resonance heating. For example, a high power microwave output could render inoperative local control electronics, such as in a directed missile incorporating a sophisticated guidance system, resulting in loss of the guidance capability. Heretofore, sophisticated electron bunching techniques had to be employed and, in the cases of the free electron laser and gyrotron, components for effecting the bunching of the electrons might be integrated within the already extremely complex traveling wave generation part of the free electron laser or gyrotron.

It is known to heterodyne optical beams. In this technique two collimated optical beams, derived from the same laser source, illuminate a common surface. One beam is the signal beam from the laser and the other beam is frequency shifted relative to the signal beam. One use for optical heterodyning is for optical demodulation. Optical heterodyning can also be used for detection of radiation, Abrams and Gandrud, "Heterodyne Detection of 10.6-μRadiation by Metal-To-Metal Point Contact Diodes", *Applied Physics Letters,* Vol. 17, No. 4, Aug. 15, 1970.

The generation of a high electron density by thermoemission from irradiating a surface with a laser beam, is also known. For further information concerning the structure and operation of such an electron source, reference may be made to U.S. Pat. No. 4,346,330. An electrical discharge device adapted to switch or attenuate a laser beam is the subject of U.S. Pat. No. 3,912,367. Finally, laser triggering of a high voltage discharge between parallel electrodes is disclosed in U.S. Pat. No. 4,401,920.

SUMMARY OF THE INVENTION

Among the several aspects of the present invention may be noted the provision of an improved electron gun. The electron gun of the present invention provides an output beam of spatially bunched electrons at high frequencies with substantially 100% modulation. This beam can be accelerated to relativistic velocity without loss of modulation so that the beam can be input to a traveling wave device of the type requiring spatially bunched electrons. This pre-bunched input results in simplification of the design and construction of the traveling wave device because it is no longer necessary to include in such devices certain components necessary to effect the bunching. The electron gun of the present invention incorporates features of conventional thermionic emitter cathode electron guns for acceleration and focusing of emitted electrons. Two laser beams of slightly different optical frequencies illuminate a photocathode in heterodyne fashion. The photocathode thereupon emits clouds of electrons at the differential or beat frequency, for example, in the 50 MHz to 1000 GHz range. Other features and objects of the present invention will be, in part, apparent and, in part, pointed out hereinafter in the following specification on and accompanying claims and drawings.

Briefly, the electron gun of the present invention includes an evacuated envelope containing a photocathode. An anode is disposed between the photocathode and the output end of the envelope for accerlerating electrons photoelectrically emitted by the photocathode. A first laser provides a first laser beam at a first frequency illuminating the photocathode while a second laser provides a second laser beam at a second frequency and also illuminates the photocathode. The first frequency differs from the second frequency by a beat frequency so that the photocathode provides the electron beam with the electrons spacially bunched in accordance with the beat frequency.

BRIEF DESCRIPTION OF THE DRAWINGS

Corresponding reference characters indicate corresponding components throughout the several views of the drawings.

DESCRIPTION THE PREFERRED EMBODIMENT

Figure 2:
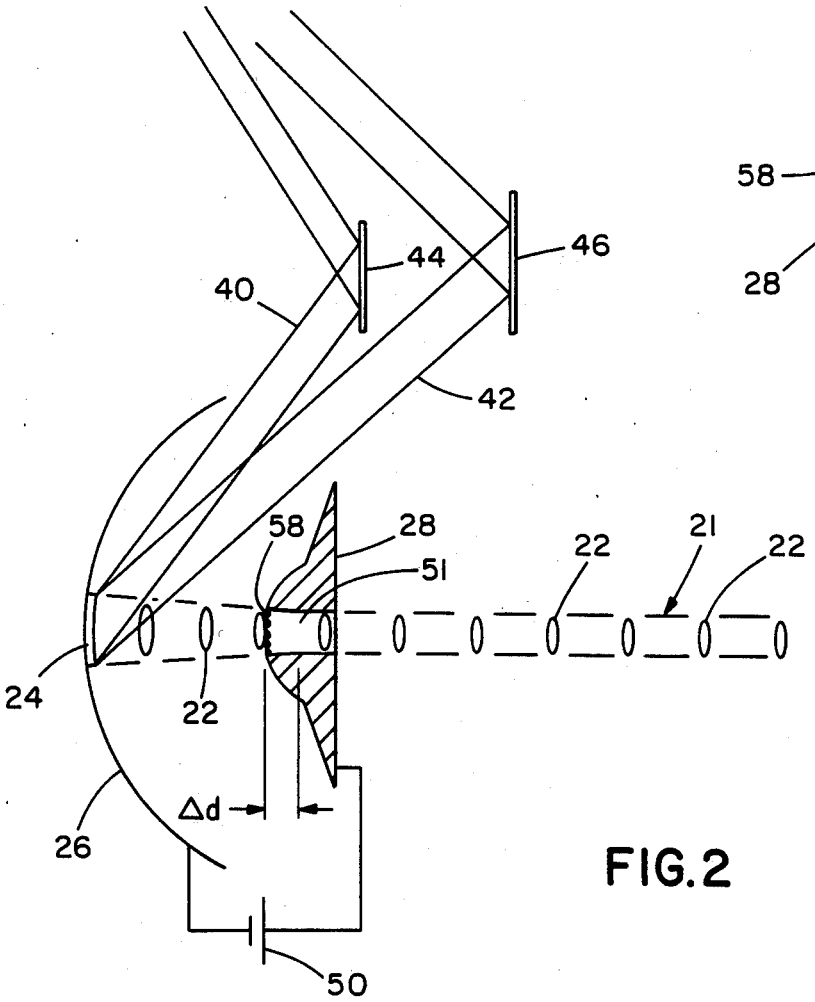
FIG. 2 illustrates a pair of laser beams illuminating a photocathode of the electron gun of FIG. 1 with emitted electrons accelerated toward and through a central aperture of an anode.

Referring now to the drawings, an electron gun of the present invention is generally indicated by reference character 20. The electron 20 gun provides an output beam 21 which is frequency modulated at very high frequencies, from 50 MHz to 1000 GHz. That is, the output beam 21 consists of spatially bunched electrons or clouds 22 of electrons, see FIG. 2. Such a modulated beam can be advantageously used as an input to a traveling wave device such as a free electron laser or a gyrotron. More specifically, it is known to use the output of a RF quadrapole accelerator, which receives electrons from a source and pre-bunches them while accelerating them to a threshold velocity, as the input to a linear accelerator (LINAC). The LINAC further accerlerates the pre-bunched electrons to relativistic velocities, and these pre-bunched relativistic electrons serve as the input to the traveling wave device. One use of the electron gun 20 of the present invention is as a replacement for the RF quadrapole accelerator. The electron gun 20 represents a modification of a standard electron gun which employs a thermionic emitter cathode. In place of the thermionic cathode, the electron 20 uses a photocathode 24 mounted on a curved focusing electrode 26 for directing the emitted electrons towards an anode 28.

Figure 1:
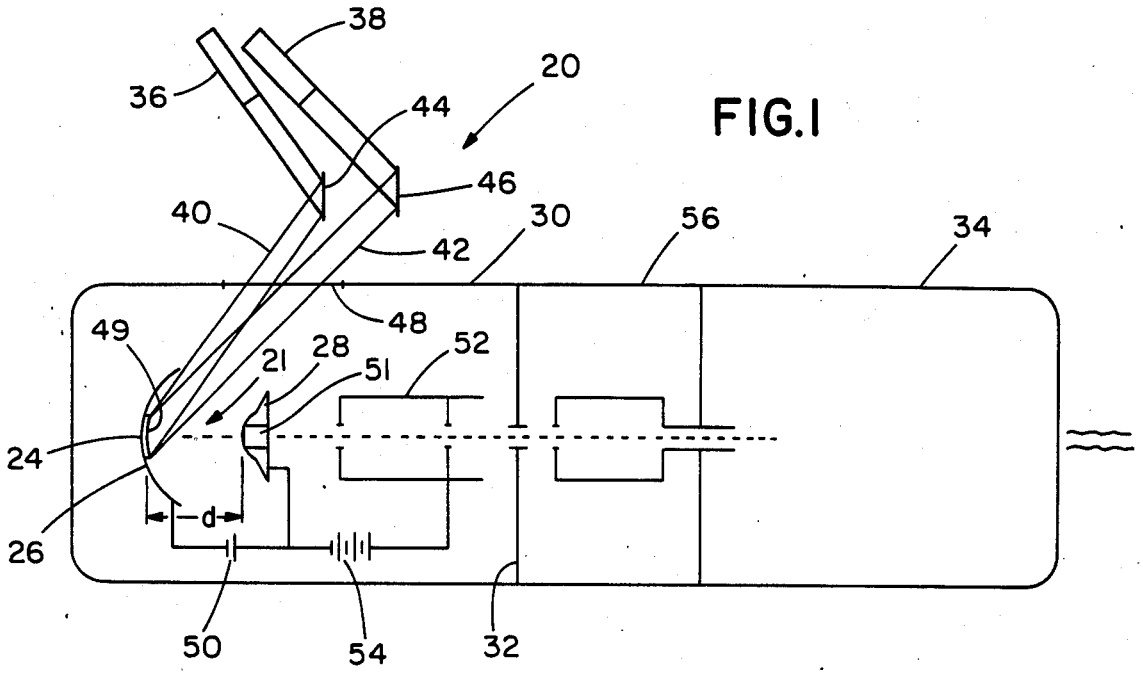
FIG. 1 is a simplified diagram, partly schematic and partly block in nature, illustrating an electron gun incorporating various features of the present invention.

More specifically, as shown in FIG. 1, the electron gun 20 includes an evacuated envelope 30 in which a vacuum has been drawn prior to its sealing against the outside environment. The envelope has an output end 32 for providing the modulated electron beam as an input to another electronic device, such as a traveling wave device 34 which is also evacuated. The gun 20 also includes a first laser 36 and a second laser 38 which may be either of the continuous wave type or the pulsed type. The lasers 36, 38 provide respective first and second laser beams 40, 42, respectively, which could be reflected by mirrors 44, 46, respectively, to pass through a transparent window 48 in the envelope 30 and to fall incident on the photocathode 24 to produce photoemission. While the laser beams 40, 42 are not parallel, they converge at a small angle and illuminate the same area on the surface 49 of the photocathode 24. Preferably, the beams illuminate the entire surface 49.

The first laser beam 40 has a frequency $\omega_1$ which is in the optical region of the electromagnetic spectrum. Similarly, the second laser beam 42 has a frequency $\omega_2$ which is also in the optical region but differs slightly from the frequency of the first laser beam by a differential or beat frequency which is in the radio frequency region. The two laser beams operate on the photocathode in heterodyne fashion so that the electron beam is modulated at the beat frequency. The electric field of the incident laser light, $E_i$, on the photocathode, is given by the sum of the electric fields from the respective lasers:

$$E_i = E_1 \cos(\omega_1 t + \phi_1) + E_2 \cos(\omega_2 t + \phi_2)$$

where $E_1$ is the electric field at the first laser beam 40 and $E_2$ is the electric field of the second laser 20 beam 42. Phase $\phi_1$ and $\phi_2$ represent arbitrary time delays associated with the respective laser beams. The radiation power at the photocathode is proportional to the square of $E_i$, $$E_i^2 = \frac{E_1^2}{2}[\cos(2\omega_1 t + 2\phi_1) + 1] + \frac{E_2^2}{2}[\cos(2\omega_2 t + \phi_2) + 1] + E_1 E_2 \{\cos[(\omega_1 - \omega_2) t + \phi_1 - \phi_2] + \cos[(\omega_1 + \omega_2) t + \phi_1 + \phi_2]\}$$

The above expression includes, in essence, four terms, three of which (the first, second and fourth terms) sum the frequencies and the remaining one of which concerns the difference in frequency of the laser beams. The photocathode is unable to respond at frequencies $\phi_1$, $\phi_2$ or the sum of the two. However, the photocathode can respond at the differential or beat frequency. The first, second and fourth terms of the equation can be disregarded as their contribution, in effect, represents a d.c. offset. With $\omega_{1-\omega 2} << \omega_1$, and $\omega_1 \approx \omega_2$, the photocathode 24 acts as a low pass frequency filter and averages the incident power over time t such that $$t >> 2\pi/\omega_i$$

but $$t >> 2\pi/(\omega_1 - \omega_2), \text{ results in}$$

$$E_i^2 = \frac{E_1^2}{2} + \frac{E_2^2}{2} + E_1 E_2 \cos[(\omega_1 - \omega_2) t + \phi_1 - \phi_1]$$

If the incident power densities from the two lasers are equal, $$E_1 = E_2 = E$$

then $$E_i^2 = E^2 + E^2 \cos[(\omega_1 - \omega_2)t + \phi_1 - \phi_2]$$

Thus the incident power is 100% modulated at the beat frequency ($\omega_{1-\omega 2}$), and the photoemission will also be modulated at this frequency. Note that the frequency and phase of the modulation are independently controllable by controlling the frequency and phase of either laser.

The photoemitted electrons are accelerated electrostatically toward the anode 28, which is positioned between the photocathode 24 and the output end 32 and which is maintained electrostatically positive with respect to the electrode 26 by potential means interconnected with the anode and electrode. The potential means is shown in the form of a battery 50. More specifically, the electrons are emitted from the cathode with a substantially cosine square distribution perpendicular to the tangent at the point of emission of arcuate photocathode emission surface 49. The electrons are emitted with relatively low energy. However, the extraction voltage between the anode 28 and the photocathode quickly accelerates the electrons to higher energy levels. The curvature of the photocathode 24 and the focusing electrode 26 serve to compensate for the space-charge effect. If left uncontrolled, the space-charge effect would, in essence, demodulate the modulated (bunched) electrons and unacceptably spread the electron beam.

The anode 28 is preferably annular and has a central aperture 51 through which the electron beam is focused by operation of the focusing electrode 26. The battery 50 and the anode 28 make up a first acceleration stage for the electron gun 20. The gun may also include a second acceleration stage which may operate electrostatically or magnetically and is shown in the form of an accelerating and focusing grid 52 which is held electrostatically positive relative to anode 28 by a potential means which is shown schematically as a battery 54. The output of the accelerating and focusing grid 52 can serve as the input to a linear accelerator 56 which further accelerates the pre-bunched electrons to relativistic velocities prior to their introduction in the traveling wave device 34. As the accelerating and focusing grid and the linear accelerator are well known to those of skill in the art, they need not be further discussed herein.

As long as the gun 20 is operated far from space-charge limited conditions, the time for electron travel from the photocathode 24 to the anode 28 is substantially independent of the emission intensity. Furthermore, the electron beam 21 remains modulated after the acceleration process.

The photocathode 24 could be formed of many materials. Among these materials are gallium arsenide or one or more of the alkali metals (lithium, sodium, potassium, rubidium or cesium) in complex combination with oxides of certain metals. While the photocathode is shown to be of the opaque type where the light incidence and photoemission occurs on the same surface 49, the photocathode could be of the semitransparent type where radiation illuminates one side of the photocathode layer while electrons are emitted photoelectrically from the opposite surface of the layer.

The spacing (d) between the photocathode 24 and the anode 28 is preferably in the range of 0.5 cm. to 2 cm., while the potential difference between them may be 80 kV. The presence of the anode aperture 51 results in the equipotential surfaces along the potential gradients between the photocathode and anode extending from the acceleration region (between the photocathode and the anode) into the drift space region (inside the aperture window). This causes electrons having trajectories which pass through the center of the aperture 51 to travel an extra distance Δd before reaching their full kinetic energy. This extra distance Δd is approximated by the aperture diameter.

Figure 3:
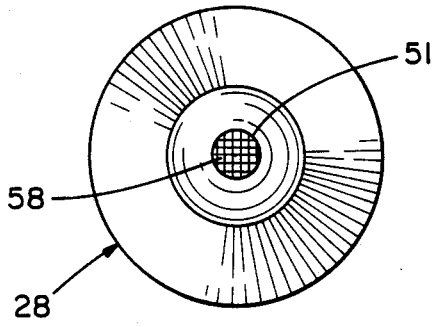
FIG. 3 is an enlarged front elevational view of the anode of the electron gun illustrating a fine mesh screen covering the central aperture.

The effect of this distance, Δd, can be estimated assuming that electrons on each trajectory experience a constant acceleration, a, over the entire distance, d. The total flight time, t, is given by the standard formula for constant acceleration over distance (assuming zero initial velocity):

$$t = \sqrt{2d/a}$$

$$t = d\sqrt{\frac{2m}{eV}}$$

$$\Delta t = \Delta d\sqrt{\frac{2m}{eV}}$$

where m is the electron mass and eV is electron volts of kinetic energy. For an 80 kV acceleration potential, and a Δt of 1 picosecond, Δd must be ≦0.08 mm. (0.003 inches). As shown in FIG. 3, a conductive screen 58 of fine mesh covers the inlet side of the aperture 51 in the anode 28. This effectively reduces the aperture diameter to satisfy the Δd requirement.

The initial electron energy spread can be shown to have a negligible effect on the electron flight time. The flight time is given by:

$$t = \frac{V_o + \sqrt{V_o^2 + 2ad}}{a}$$

where $V_o$ is the initial velocity of the electron in the direction of the acceleration, a. The time spread, Δt, produced by a velocity spread, $\Delta V_o$, is given by $$t = \frac{\Delta V_o}{a} + \frac{V_o \Delta V}{a\sqrt{V_o^2 + 2ad}}$$

Using an energy spread equal to the energy of the incident photons, i.e., $\Delta E = 2.8eV$ or $\Delta V_o = 1 \times 10^6$ m/s $$\Delta t = 0.7 \text{ ps}$$

This time is small compared with the period of the beat frequency $[2\pi/(\omega_1 - \omega_2)]$. Thus the initial electron energy spread will not have a significant effect.

As a method for providing a modulated electron beams wherein the electrons are spacially bunched in clouds, the present invention includes the following steps:

(a) Direct a first laser beam having a first frequency onto a photocathode.

(b) Direct a second laser beam having a second frequency onto the photocathode, the second frequency differing from the first frequency by a beat frequency of between 50 MHz and 1000 GHz.

(c) Accelerate electrons emitted by photoemission from the photocathode toward an output end.

Figure 4:
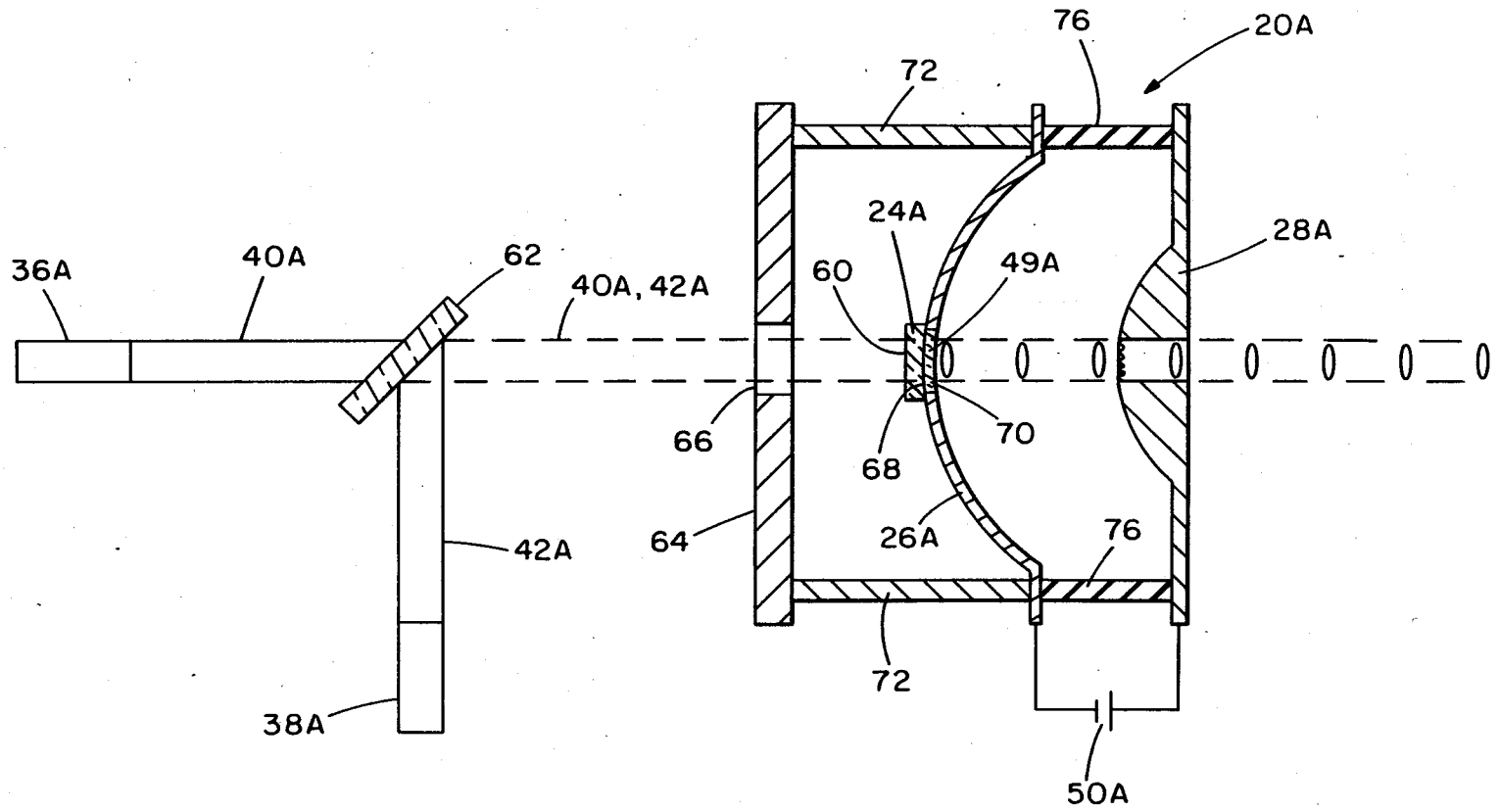
FIG. 4 is a simplified diagram of a portion of an alternative embodiment of the electron gun of the present invention incorporating a semitransparent photocathode.

Referring now to FIG. 4, a portion of an alternative preferred embodiment 20A of the electron gun of the present invention is shown. Components of electron gun 20A corresponding to components of electron gun 20 are designated by the reference character applied to the component of the electron gun 20 with the addition of the suffix "A". Among the major differences between the two embodiments of the electron gun are that the photoemissive cathode 24A is semitransparent with light falling incident on side 60 and electrons being emitted from side 49A, and the beams 40A, 42A are caused to be coincidental instead of converging at a small angle.

The electron gun 20A includes the lasers 36A, 38A which are arranged to provide their respective beams 40A, 42A at a right angle to one another and intersecting at a dichroic mirror 62. The dichroic mirror has the property that it passes light at the frequency of laser beam 40A and reflects light at the frequency of laser beam 42A. As the mirror is positioned at a 45° angle with respect to both laser beams, the mirror causes the beams to become coincidental. The electron gun 20A further includes a mounting plate 64 having a central aperture 66 for passing the coincidental beams 40A, 42A to the light-receiving side 60 of photocathode 24A.

The photocathode 24A is deposited directly on the convex surface 68 of a polished arcuate window 70 which forms part of the evacuated envelope 30A of the electron gun 20A. The peripheral portion of photocathode 24A overlaps a spherical, metallic cathode electrode 26A for providing electrical contact to the photocathode and electron beam focussing. The window 70 and/or cathode electrode 26A may be attached to the mounting plate 64 by means of mounting rods 72. The anode 28A can be mounted using insulative extensions 76 of the mounting rods 72. Remaining components of the electron gun 20A are similar to those of electron gun 20. As with electron gun 20, the parameters of electron 20A, including anode and cathode radii and spacing, photoemissive material and size and bias voltage, will be in accordance with the electron beam energy, current and diameter required for a particular application.

In view of the above, it will be seen that the several objects of the invention are achieved and other advantageous results attained.

As various changes could be made in the above construction without departing from the scope of the invention, it is intended that all matter contained in the above description or shown in the accompanying drawins shall be interpreted as illustrative and not in a limiting sense.

What is claimed is:

1. An electron gun for emitting a modulated high power electron beam comprising:

an evacuated envelope having an output end;

a photocathode disposed in said envelope for emitting electrons in response to the exposure to light;

an anode positioned between said photocathode and said output end for accelerating electrons emitted by said photocathode;

potential means interconnected between said anode and said photocathode for maintaining said anode electrostatically positive relative to said photocathode;

a first laser providing a first laser beam at a first frequency illuminating said photocathode, and a second laser providing a second laser beam at a second frequency illuminating said photocathode at the same time, said first frequency differing from said second frequency by a beat frequency, whereby said photocathode provides said electron beam of electrons in which the electrons are spatially bunched in accordance with said beat frequency, said anode being annular and having a central aperture for passing said electron beam, said anode including an electrically conductive mesh screen positioned over said aperture, said beat frequency being between 50 MHz and 100 GHz, the spacing between said photocathode and said anode being between 0.5 cm and 2 cm, and said potential means providing a potential difference between said photocathode and said anode of between 50 kV and 100 kV.

2. An electron gun as set forth in claim 1 wherein said anode and said potential means constitute, in part, a first accelerator, said electron gun further comprising a second accelerator disposed between said anode and said output for further accelerating the electrons in said beam.

3. An electron gun as set forth in claim 1 wherein the power density of said first laser beam incident on said photocathode is substantially equal to the power density of said second laser beam incident on said photocathode whereby said electron beam is substantially one hundred percent modulated at said beat frequency.

4. An electron gun as set forth in claim 1 wherein said photocathode is semitransparent and has a light-receiving side and a photoemissive side facing said anode.

5. An electron gun as set forth in claim 4 further comprising a dichroic mirror having the property that it passes light at said first frequency and reflects light at said frequency.

6. An electron gun as set forth in claim 5 wherein said first and second lasers are arranged to provide beams intersecting at a right angle at said mirror, said mirror being arranged at a 45° angle with respect to each beam whereby said beams are caused to become coincidental.

7. An electron gun as set forth in claim 1 wherein said first laser and said second laser are continuous wave lasers.

8. An electron gun as set forth in claim 4 wherein said first laser and said second laser are pulsed lasers.

9. An electron gun as set forth in claim 1 wherein said photocathode is mounted on a shaped electrode for focusing said electron beam.

10. An electron gun as set forth in claim 1 wherein said conductive screen covers the inlet side of the aperture in said anode.

* * * * *

UNITED STATES PATENT AND TRADEMARK OFFICE

CERTIFICATE OF CORRECTION

PATENT NO. : 4,703,228

DATED : October 27, 1987

INVENTOR(S) : William P. West

It is certified that error appears in the above-identified patent and that said Letters Patent is hereby corrected as shown below:

Face of Patent, within "Other Publications", change "Grandrud" to --Gandrud--.

Column 2, line 9, after "specification" delete "on".

Column 2, line 14, change "accerlerating" to --accelerating--.

Column 2, line 22, change "spacially" to --spatially--.

Column 2, line 44, after "Description" insert --of--.

Column 2, line 60, change "accerlerates" to --accelerates--.

Column 3, line 37, delete "20".

Column 3, line 38, change "Phase" to --Phases--.

Column 3, line 47, change "$[\cos (2\omega_2 t + \phi_2) + 1]$" to --$[\cos (2\omega_2 t + 2\phi_2) + 1]$--.

Column 3, line 62, change "$\omega_1 - \omega 2 << \omega_1$, and $\omega_1 = \omega 2$" to --$\omega_1 - \omega_2 << \omega_1$, and $\omega_1 = \omega_2$--.

UNITED STATES PATENT AND TRADEMARK OFFICE

CERTIFICATE OF CORRECTION

PATENT NO. : 4,703,228

DATED : October 27, 1987

INVENTOR(S) : William P. West

It is certified that error appears in the above-identified patent and that said Letters Patent is hereby corrected as shown below:

Column 4, line 5, change "$[(\omega_1 - \omega_2)t + \phi_1 - \phi_1]$" to --$[(\omega_1 - \omega_2)t + \phi_1 - \phi_2]$--.

Column 4, line 16, change "$(\omega_1 - \omega_2)$" to --$(\omega_1 - \omega_2)$--.

Column 5, line 60, change "mls" to --m/s,--.

Column 5, line 68, change "beams" to --beam--.

Column 5, line 68, change "spacially" to --spatially--.

Column 6, line 43, change "focussing" to --focusing--.

Column 6, line 62, change "drawins" to --drawings--.

Signed and Sealed this

Third Day of May, 1988

*Attest:*

*Attesting Officer*

DONALD J. QUIGG

*Commissioner of Patents and Trademarks*